US007000958B2

(12) United States Patent
Garza et al.

(10) Patent No.: US 7,000,958 B2
(45) Date of Patent: Feb. 21, 2006

(54) ASSIST DEVICE FOR A DOOR HANDLE AND LATCH ASSEMBLY

(76) Inventors: Gilbert Garza, 4613 Weymouth St., Lake Worth, FL (US) 33463; Lisamarie Garza, 4613 Weymouth St., Lake Worth, FL (US) 33463

( * ) Notice: Subject to any disclaimer, the term of this patent is extended or adjusted under 35 U.S.C. 154(b) by 0 days.

(21) Appl. No.: 10/759,144

(22) Filed: Jan. 20, 2004

(65) Prior Publication Data

US 2005/0156440 A1 Jul. 21, 2005

(51) Int. Cl.
*E05B 3/00* (2006.01)

(52) U.S. Cl. ..... 292/336.3; 292/92; 292/93; 292/352; 292/DIG. 65; 16/413; 16/426; 16/427

(58) Field of Classification Search ..... 292/336.3, 292/92, 93, 352, DIG. 2, DIG. 54, DIG. 65; 16/422, 426, 427, 429, 413; 403/263, 361
See application file for complete search history.

(56) References Cited

U.S. PATENT DOCUMENTS 943,973 A * 12/1909 Hope et al. ..... 292/92
975,456 A * 11/1910 Prevost ..... 292/93
1,105,252 A * 7/1914 Carstens ..... 292/92
2,087,165 A * 7/1937 Ruth ..... 292/92
2,104,618 A * 1/1938 Hasenfuss ..... 292/93
2,594,878 A * 4/1952 Davis ..... 403/24
2,784,021 A * 3/1957 Guckenberger ..... 292/336.3
2,871,050 A * 1/1959 Dickinson ..... 292/336.3
2,945,372 A * 7/1960 Reed ..... 70/92
2,980,459 A * 4/1961 Schwanz et al. ..... 292/122
2,992,846 A * 7/1961 Schwanz et al. ..... 292/127
3,025,095 A * 3/1962 Christensen ..... 292/336.3
4,101,153 A * 7/1978 Dozier ..... 292/92
4,181,335 A * 1/1980 Thoren ..... 292/92
4,185,859 A * 1/1980 Cunningham ..... 292/93
4,629,228 A * 12/1986 Marko et al. ..... 292/165
5,331,869 A * 7/1994 Webb ..... 81/177.1
5,713,614 A * 2/1998 Anderson ..... 292/336.3
5,769,145 A * 6/1998 Kwatonowski ..... 160/371
6,055,774 A * 5/2000 Muddiman ..... 49/141
6,102,451 A * 8/2000 Merryman ..... 292/92
6,601,881 B1 * 8/2003 Mandell et al. ..... 292/92

* cited by examiner

*Primary Examiner*—Brian E. Glessner
*Assistant Examiner*—Carlos Lugo
(74) *Attorney, Agent, or Firm*—Frank A. Spear

(57) ABSTRACT

An assist device for a door handle comprises an elongated bar which has one end pivoting about a pivot pin and another end receiving a pivot piece therein. The parts interact to produce a tight looking, attractive, easy-to-assemble, and sturdy device with no sharp projecting parts.

10 Claims, 7 Drawing Sheets

FIG. 3
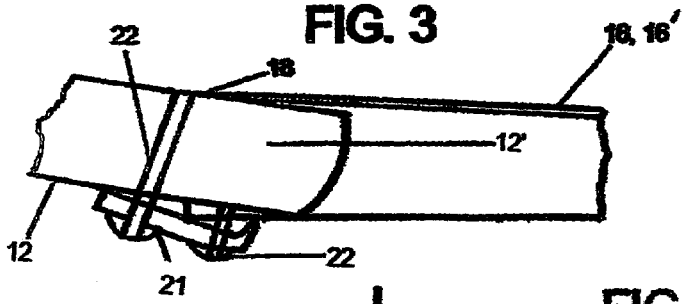
FIG. 4
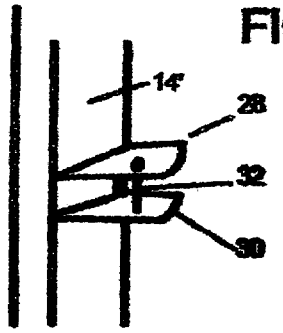
FIG. 5
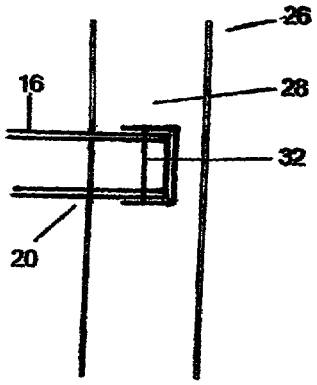
FIG. 6
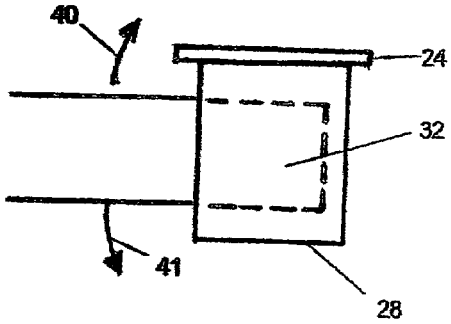
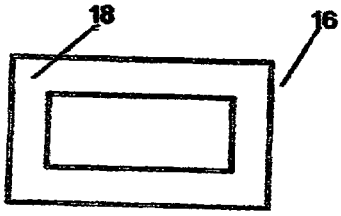
FIG. 7

ASSIST DEVICE FOR A DOOR HANDLE AND LATCH ASSEMBLY

BACKGROUND OF THE INVENTION

1. Field of the Invention

This invention relates to an assist device which is secured to a pivotally connected, push-pull type handle for operation of a latch assembly of a door in order that the door may be opened by a person without requiring direct hands-on contact of the assist device or handle thereof.

2. Description of the Related Art

In today's fast paced society, it is common practice for a person's hands to be completely or at least partially occupied by the support and carrying of a variety of packages, bundles, brief cases, and even smaller objects such as glasses, plates, keys, etc. When the hands of a person are occupied and a person still wishes to pass through a door, considerable time is wasted in the rearranging of the carried packages or bundles or, even more inconveniently, the release or re-positioning of such packages on the floor, ground or other areas.

It is of course recognized that certain doors are designed to include handles, locks and/or latch assemblies which are specifically intended to be relatively complicated in order to prevent unauthorized entries. Typical doors, handles, and associated latch assemblies of this type are presently used or installed in association with the primary or more frequently used entrances of a business, dwelling, etc. However, other much more simplified latch assemblies are frequently utilized for doors which are not specifically structured to prevent unauthorized access.

More specifically, screen doors are typically used in association with door ways which lead from the interior of a home or like structure out onto a porch, patio, pool area, etc. Such doors are, for the most part, made from webbing or screens surrounded by a metallic or like rigid material door frame. Screen doors of course have as their primary purpose to allow the passage of air flow therethrough as well as allow clear viewing through the screening portion of such doors. Similarly, the handle and latch assemblies of such doors normally do not include a rotationally mounted door know but rather utilize a relatively inexpensive, light weight, pivotally mounted handle of the "push-pull" type. In opening such doors the handle is generally forced inwardly (or outwardly) to orient the latch assembly associated therewith, into a latch-open position. However, such handles and associated latch assemblies may be particularly difficult to open when, as set forth above, the person's hands are occupied. This is typically the case when one or more people are desirous of bringing plates of foods, beverages, etc. from a kitchen area out to a patio, porch or pool area. Also, when the hands of a person are so occupied, the opening of the screen door or similar structure is frequently accomplished using the hip or other convenient and correspondingly positioned portion of a person's body to "bump" against the handle, in an attempt to force the latch assembly associated therewith, into an open position.

However, because of the simplistic design and relatively inexpensive material from which such door handles and associated latch assemblies are structured, their workings are relatively imprecise, at least to the extent that the interacting components which serve to define a latch-open or a latch-closed position do not always operate efficiently or consistently. As a result, manipulation of the aforementioned handle is rendered somewhat difficult and erratic wherein, such erratic operation often increases with age and wear particularly when such devices are frequently exposed to the sometimes harsh environment of the outdoors.

Merryman (U.S. Pat. No. 6,102,451) shows an assist device that is somewhat "loose" looking (handle in flared part 19 of FIG. 3) with projections such as shown by the ends of cotter pin 17 (FIG. 4).

Kwatonowski (U.S. Pat. No. 5,769,145) shows a "loose" looking assist device (see parts 7 and 8A of FIG. 2) which uses a flat spring 11 at one end.

There is a need for an improved device or mechanism, which allows the effective operation of a handle and associated latch structure and thereby facilitates the opening and closing of the door without requiring a person to firmly grip and or even directly contact the handle or the improved assist device itself. Such an improved assist device should be easily, quickly and efficiently connected to an existing door handle without requiring any structural modification thereor, or the door to which it is attached.

Such an improved assist device should also be disposed and structured for easy attachment to a handle and have a configuration which facilitates the manipulation of the handle and its latch not only by adults but also by small children who may be of an age which do not totally comprehend the workings of a door handle in terms of improper push-pull or rotary action that must be applied thereto in order to orient the latch of the door between an open or closed position. In the case of extremely small children the latch associated with a screen door or other type of door utilizing such a push-pull handle and latch structure should be capable of being locked in the normal conventional fashion but should also be disposed and configured to allow even children in the toddler age group to manipulate the assist device in order to open the door when it is not intentionally locked.

SUMMARY OF THE INVENTION

The present invention is directed towards an assist device structured to facilitate the opening of a door, particularly, but not exclusively of the screen door type, wherein the door handle and latch assembly associated therewith is selectively positionable between a latch-open and a latch closed position, by the pivotable, "push-pull" action of the handle, normally requiring the utilization of at least one hand of a person. More specifically, the assist device of the present invention is designed to allow manipulation of the handle into a "latch-open" position without requiring direct engagement or manipulation of either the assist device or the handle directly by either of the hands of a person.

The assist device of the present invention comprises a bar having an elongated configuration terminating in a proximal end and an oppositely disposed distal end. The bar may be made available in any one of a plurality of different lengths. However, in at least one embodiment of the present invention the length of the bar is such that when in an operative position relative to the door handle, it extends transversely across substantially the entire width of the door.

The proximal end of the bar interacts with the handle. The distal end of the bar is secured to a brace member and/or a spaced apart portion of the door itself in order that the elongated bar is movably supported on the door at both its proximal and distal ends. This type of support facilitates the application or exertion of a force on the bar, utilizing the hips, upper thighs, or any other convenient and appropriate portion of a person's body. The appropriate force is typically demonstrated by exerting an inward push on the bar in order that the handle is positioned or orientated so as to move the associated latch assembly into the required "latch-open" position. Further, the movable yet secured support and/or attachment of the bar to the door, in the manner described above, allows an inwardly or other appropriately directed force to be exerted at any of a plurality of locations along the length of the bar and thereby effectively manipulate the handle, into the aforementioned latch-open position.

As set forth above, at least one embodiment of the present invention includes the length of the bar being sufficient to extend substantially across the entire width of the door and in generally perpendicular or otherwise transverse relation to the length of the door. In at least one alternate embodiment of the present invention, the bar may have a length somewhat less than the width of the door. In this embodiment the distal end of the bar is connected to either a brace member and/or to a portion of the door itself in a manner that allows at least minimal movement of the distal end relative to the door when an applicable force is supplied to the bar in an attempt to position the handle and the associated latch assembly into the aforementioned latch-open position. Therefore, regardless of the length of the bar a force may be applied thereto at almost any of a plurality of points or locations along its length in order to force the handle into the latch-open position.

The conventional structuring of the handle and its conventional, associated latch assembly is such that the handle will be biased outwardly back into the latch-closed position, when the force or pressure is released from the bar. Therefore a mere "bump" need only be exerted on an exposed, outer portion of the bar in order that the handle be forced or pivoted inwardly into the latch-open position.

Other features associated with the assist device of the present invention is the simple and easy attachment of the bar to the handle and other portions of the door. In addition, such attachment or mounting of the bar to the handle, in the manner set forth above, does not interfere with a conventional operation of the handle and associated latch assembly, particularly relating to the ability to selectively lock or unlock the door, as desired. This will allow the conventional door handle and associated latch to be locked or unlocked as an added safety measure, so as to prevent small children from passing through the door, unattended. However, the location and configuration of the bar when mounted in its operative position on the handle and door, facilitates use by adults and children alike in order that passage through the opening, with which the door is associated, is greatly facilitated.

In a preferred embodiment of the invention, illustrated in FIGS. 8–11, the synergistic interaction of a pivot piece, u-shaped bracket (with a pivot pin) and bar produces an attractive, easy to assemble and sturdy assist device with no sharp projecting parts.

BRIEF DESCRIPTION OF THE DRAWINGS

For a fuller understanding of the nature of the present invention, reference should be had to the following detailed description taken in connection with the accompanying drawings in which:

FIG. 3 is a top interior view partial cut away of the attachment of the bar to a conventional handle.

FIG. 4 is a perspective view of one embodiment of the present invention, wherein the opposite end of the bar is supported on the door or an associated brace member.

FIG. 5 is a front view of the embodiment of FIG. 4.

FIG. 6 is a top view in partial phantom and cutaway of the embodiment of FIGS. 4 and 5.

FIG. 7 is an end view of a proximal open end of the bar of the present invention.

Like reference numerals refer to like parts throughout the several views of the drawings.

DETAILED DESCRIPTION OF THE PREFERRED EMBODIMENTS

As shown in the accompanying Figures, the present invention is directed to an assist device generally indicated as 10 which is designed and structured to efficiently position a door handle, generally indicated as 12, and an associated latch assembly (not shown for purposes of clarity) on a screen door or similar type of closure structure, generally indicated as 14. The door handle 12 is of the type that is generally pivotally connected to the frame of the door 14 and is conventionally designed to be a "push-pull" type of handle normally requiring the gripping thereof by at least a single hand of a person passing through the door opening.

Figure 2:
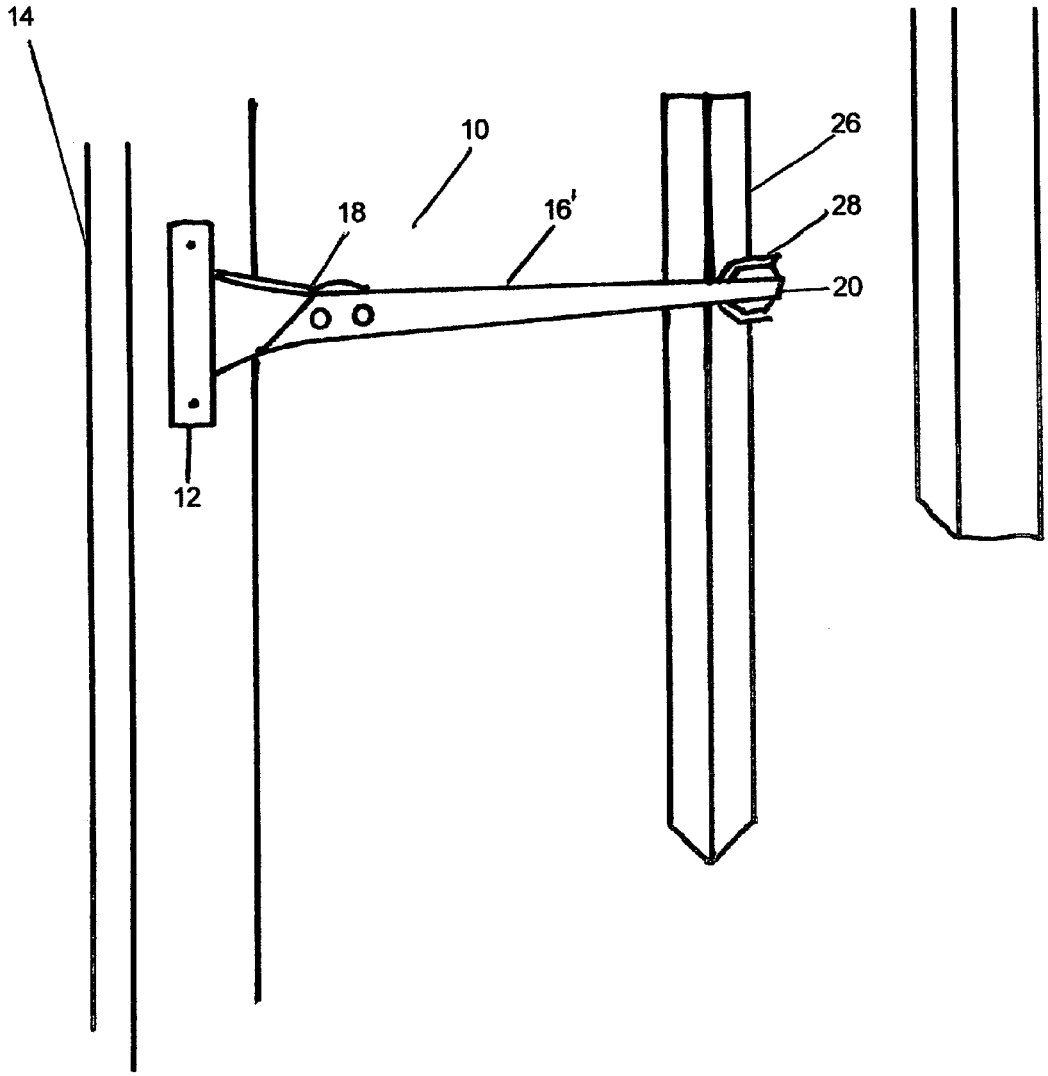
FIG. 2 is a perspective view of another embodiment of the assist device of the present invention.

More specifically, the assist device 10 of the present invention comprises an elongated bar 16 which preferably, but not exclusively comprises a tubular construction as best shown in FIG. 7. The bar 16 includes a proximal end generally indicated as 18 and a distal end generally indicated as 20. The bar 16 is formed from a rigid material and in at least one embodiment, has a length sufficient to extend substantially across the entire width of the door 14 and in transverse or even perpendicular relation to the length thereof. Obviously, the specific orientation of the bar, in terms of its transverse positioning relative to the length of the door 14, can vary. However, the bar should be conveniently disposed to allow manipulation of the handle 12, by persons of all ages and sizes, without requiring hands-on contact or engagement directly with the bar 16, as will be explained in greater detail hereinafter. With reference to FIG. 2, it is apparent that the length of the bar, indicated as 16', may vary and may extend transversely across the door 14 at a location which is generally less than the entire width of the door 14.

Figure 1:
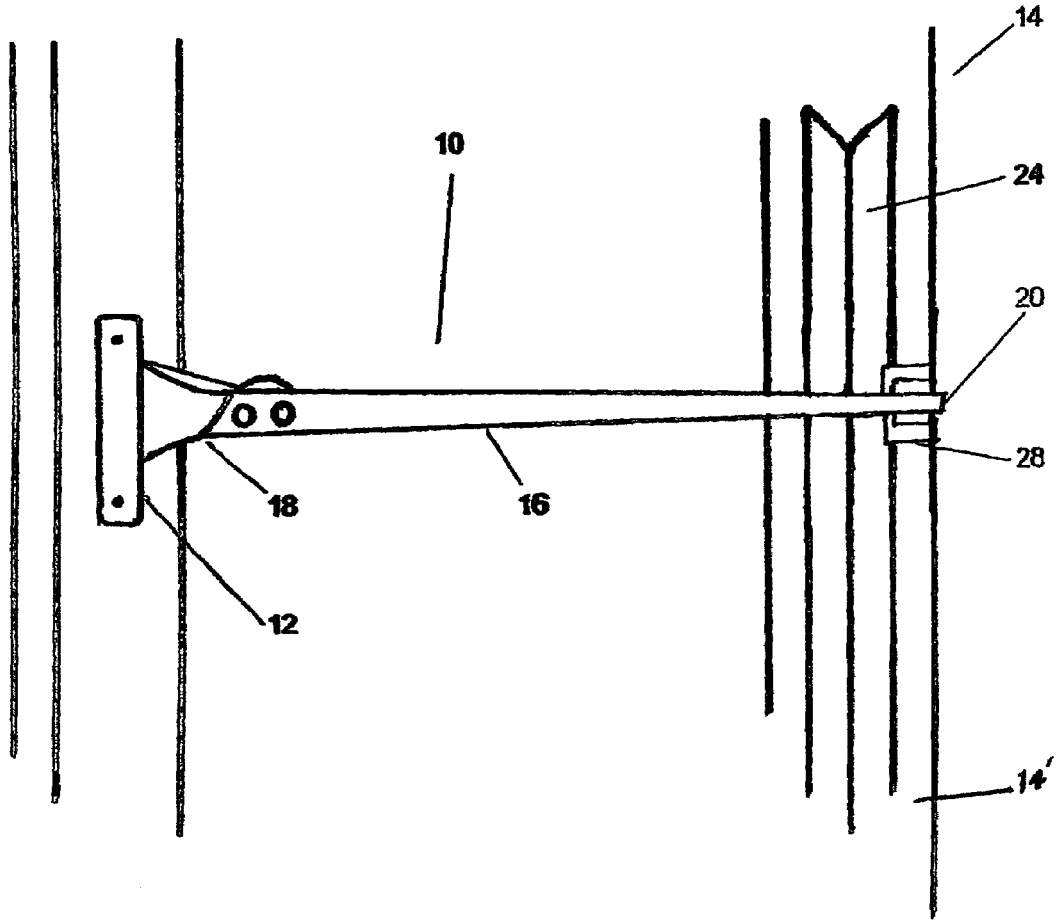
FIG. 1 is a perspective view of the assist device including a bar mounted on one face of the door and connected to a conventional door handle.

In either the embodiment of FIGS. 1 and 2, the bar 16 and/or 16' has its proximal end 18 interacting with handle 12. With reference to FIGS. 3 and 7, the bar 16 and/or 16' may include an open proximal end 18, whether or not the entire length of the bar 16 is tubular or not. However, as shown in FIG. 3, the open, proximal end is sufficiently dimensioned to receive a free end 12' of the handle 12 at least partially into the interior of the bar 16 or 16'. Further, a connecting tab or link as at 21 may be secured both to the proximal end 18 of the bar and to handle 12 by connectors 22.

The opposite or distal end 20 of the bar 16, 16' is interconnected to the door 14 in supported relation thereon. More specifically, in the embodiment of FIG. 1, wherein the bar 16 has a length sufficient to extend substantially across the entire width of the door 14, the distal end 20 may be connected to a brace member 24, which in turn may be attached or mounted on a correspondingly positioned portion or frame of the door 14 as at 14'. In the embodiment of FIG. 2, the length of bar 16' extends only partially across the width of the door 14. In this embodiment a supplementary brace member as at 26 is utilized to support and interconnect the distal end 20 of the bar 16 to the door 14. It should be further noted that in either of the embodiments of FIGS. 1 and 2 the brace member may be defined directly by a door frame 14' or another appropriately positioned portion of the door 14, depending upon the overall design and structure of the door 14.

In either embodiment, however, both the proximal end 14 and the distal end 20 are attached and/or interconnected in generally supporting relation on the door 14. With further regard to the proximal end 18, it interacts with the handle so as to move therewith when an inwardly directed force or pushing is exerted on the outer, exposed portion of the bar 16, whether or not such force is exerted thereon by the hand or other conveniently located portion of a person's body, such as the hip, upper thigh, etc.

With reference to FIGS. 4 through 6, the distal end 20 is pivotally or otherwise movably secured to either the brace member 24,26 and/or to a portion of the door or door frame 14' by means of a connector generally indicated as 28. In one embodiment of the present invention, the connector 28 includes a u-shaped bracket 30 having a connecting pin, bolt or like elongated member 32, passing through the proximal end 20 of the bar 16. By virtue of this supported connection of the distal end 20 onto the door 14,14' or brace member 24,26, the bar 16,16' is allowed to at least minimally pivot, as indicated by the directional arrows of FIG. 6 as the bar 16,16' is forced inwardly towards the face of the door 14, so as to orient the handle 12 in a latch-open position. In the top view of FIG. 6, directional arrow 40 represents at least a minimal pivotal movement of the bar 16, as an inwardly directed force is applied to the bar 16 in order to move the handle 12 and its associated latch assembly into the aforementioned latch-open position. Similarly, the normal and conventional structural operation of the handle 12 and its associated latch assembly are structure to be normally biased outwardly into a latch closed position, wherein the bar 16 will pivot at least minimally outward in accordance with the directional arrow 41.

By virtue of this construction, the assist device 10 comprising the bar 16 or 16' is orientated so as to facilitate orientation of the handle 12 into a latch-open position, without requiring the direct contact by the hands of the person. This thereby facilitates opening of the door 14, such as when the person's hands are occupied. Also children may more easily open a door 14 equipped with the assist device 10 in that small children frequently do not have the manual dexterity to properly or at least efficiently manipulate a conventional handle structure 12, of the type described. However, it should be emphasized that the assist device 10 is structured to allow locking of the handle and/or associated latch assembly in the conventional manner in order to prevent opening of the door by small children, when such is desired.

Figures 8, 9:
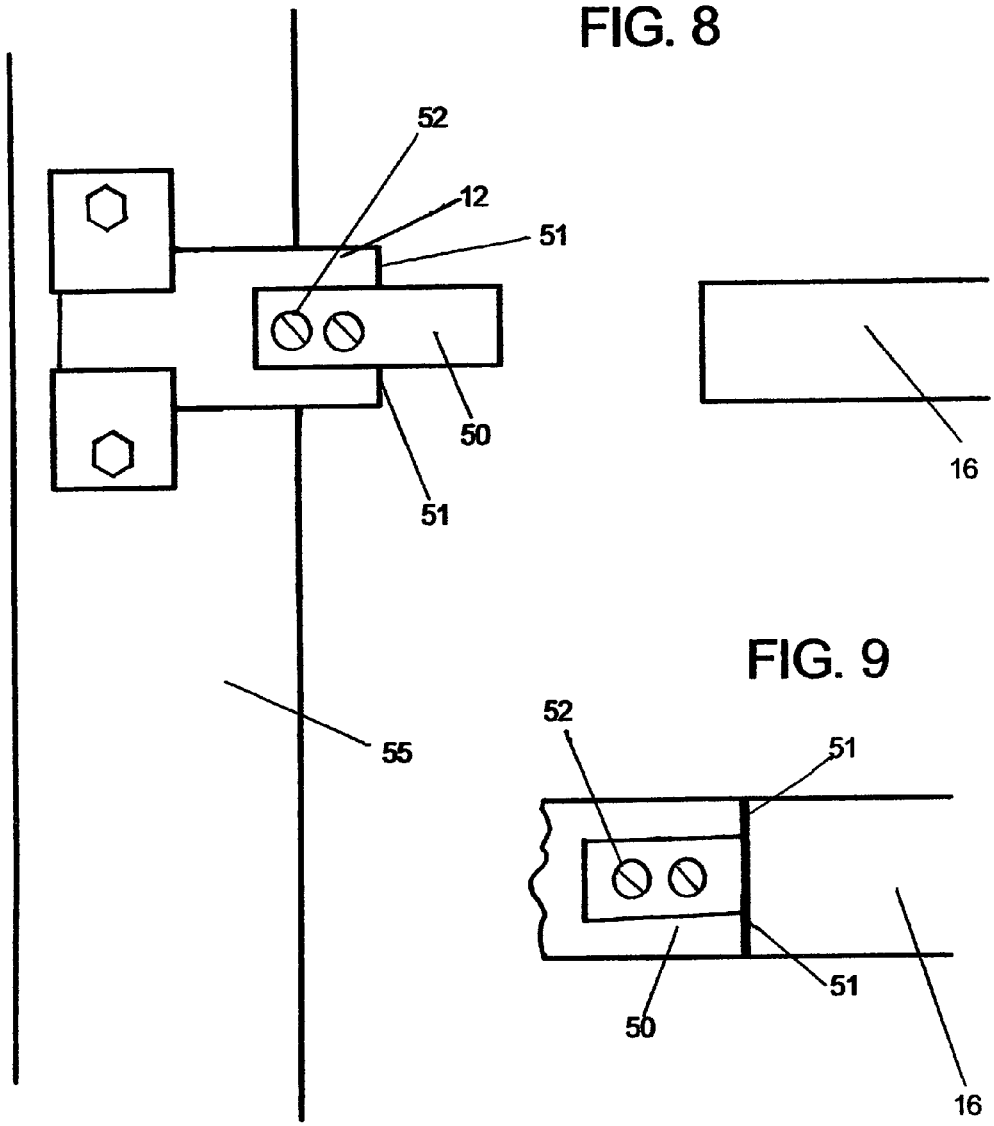
FIG. 8 is a perspective view of the door handle with the pivot piece apart from the bar.
FIG. 9 is a partial view of FIG. 8 showing the pivot piece snugly received in the bar.

A preferred embodiment of the invention is shown in FIGS. 8–11 of the drawings. The door handle 12 (FIG. 8) is provided with a pivot piece 50 sturdily attached thereto with a pair of nuts and bolts 52. The pivot piece 50 does not extend completely across the width of handle 12 and hence when in place leaves shoulders 51 on handle 12. In this embodiment, the pivot piece is a flat rectangular piece about 1⅞ inches long by about ⅝ inches wide; and projects about ⅞ inches from the end of the handle. The pivot piece is about 1/16 inches thick. As shown in FIG. 9, the pivot piece is inserted into bar 16 to form a tight, attractive fit with the end of the bar in close proximity to the shoulders. The bar is a hollow tube with a square cross-sectional shape and a wall thickness of about 1/16 inch, and having about ¾ inch sides.

Figure 11:
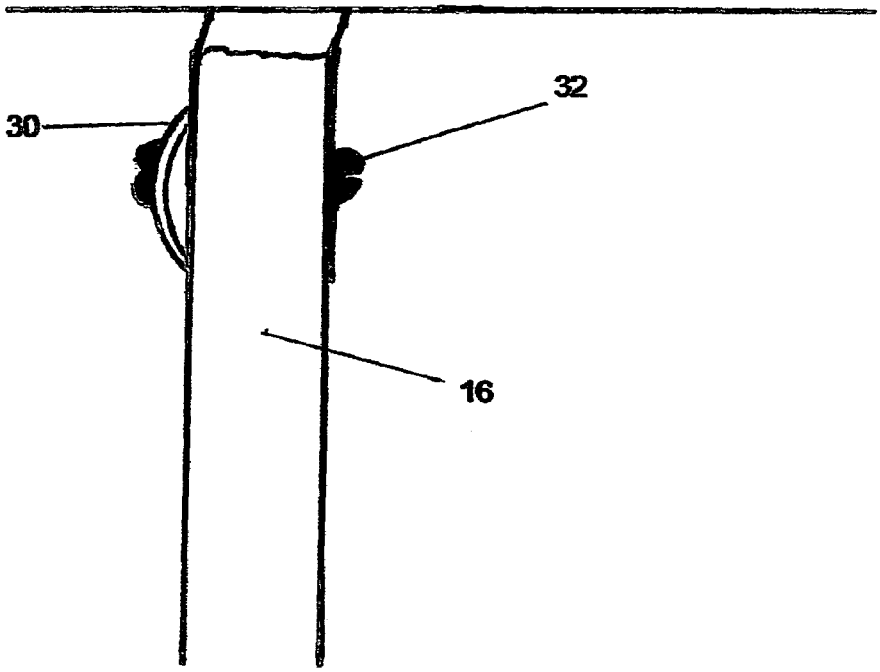
FIG. 11 is a perspectice view showing the bar snugly received in the u-shaped bracket.

FIG. 11 shows the other end of bar 16 attached to u-shaped bracket 30 by pivot pin 32. Bracket 30 and pivot pin 32 are selected to add attractiveness and stability to the assist device. Pivot pin 32 consists of a long inside threaded bolt about one inch long with an outside diameter of about 3/16 inch; and a short outside threaded bolt about ⅜ inches long with an outside diameter of about ⅛ inches. The short bolt is screwed into the large bolt. Either or both bolts have screwdriver slots as shown in FIG. 11.

FIG. 11 further shows the tight and attractive fit of bar 16 secured to bracket 30 by pivot pin 32. The bracket is about 1¾ inches long and about 1⅛ inches high. It is noteworthy that the holes in the bar receiving the pivot pin bolts are not at a point halfway up the bar sides. Rather, the hole centers are about ¼ inch from the top of the bar, and pass through the top part of the bracket. Hence the part of the bar near the pivot pin fits snugly and attractively within the bracket. The tops of the bracket sides project slightly above the top of the bar as shown in FIG. 11. It is surprising that a "pivoting" bar can have such tight, sturdy and attractive supports.

The bar, pivot piece and u-shaped bracket can be made from various metals, plastic and woods. Aluminum is the preferred material.

Figure 10:
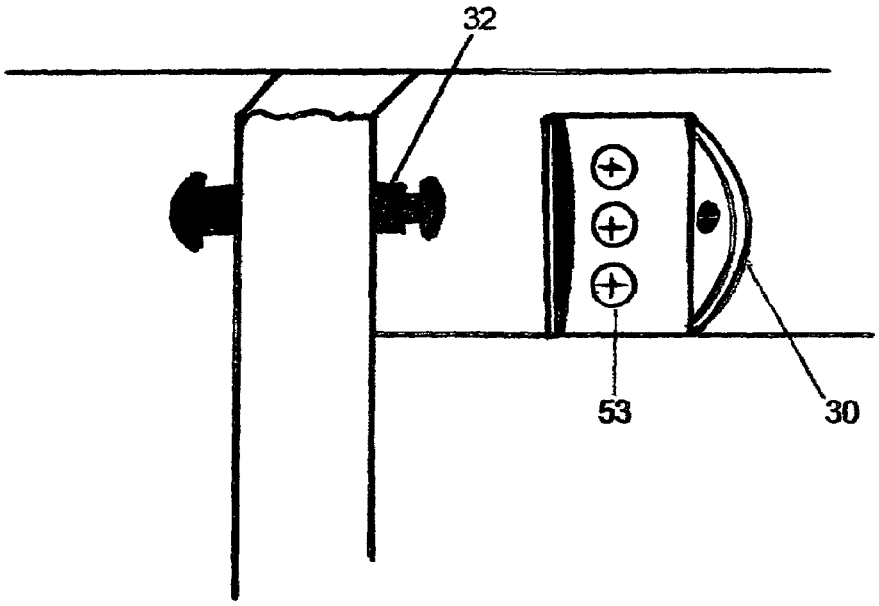
FIG. 10 is a perspective view of the bar with the pivot pin therein, both apart from the u-shaped bracket which is sturdily mounted on the door support.

FIG. 10 shows the sturdy attachment of the bracket 30 to the door support using as least two screws.

FIG. 8 shows the protruding pivot piece 50 before its insertion into bar 16.

FIG. 9 shows the bar 16 in close proximity to shoulders 51 after insertion of the pivot piece into the bar.

Figure 12:
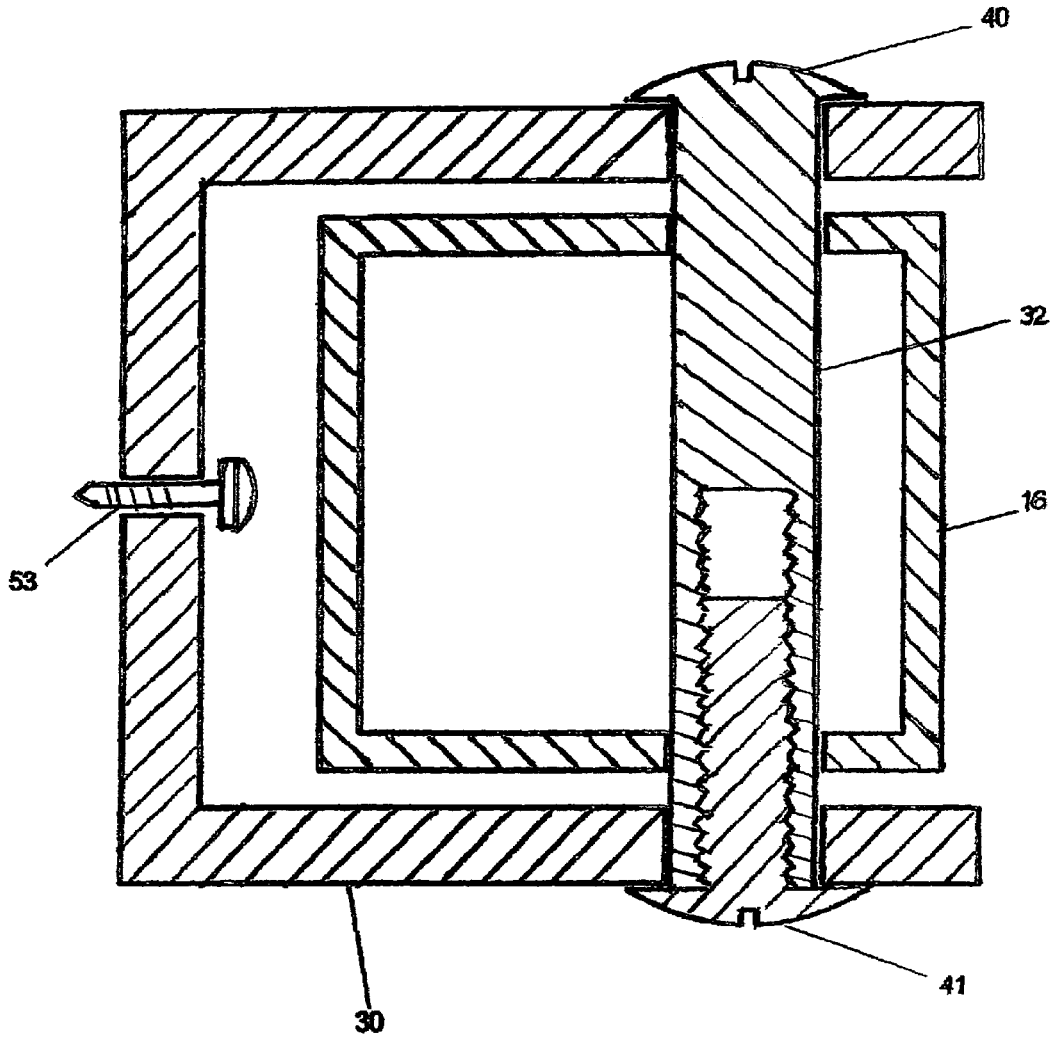
FIG. 12 is a sectional view taken transversely to the longitudinal axis of the elongated bar 16 shown in FIG. 11, and passing through the bracket 30, bar 16, the pivot pin 32 and the mounting screw 53.

FIG. 12 shows bar 16 secured entirely within bracket 30 by pivot pin 32. Pivot pin 32 is comprised of outside threaded short bolt screwed into long inside threaded bolt 40. The bracket is secured to a door or a door bracket support by multiple screws, one of which is shown (see screw 53).

Figure 13:
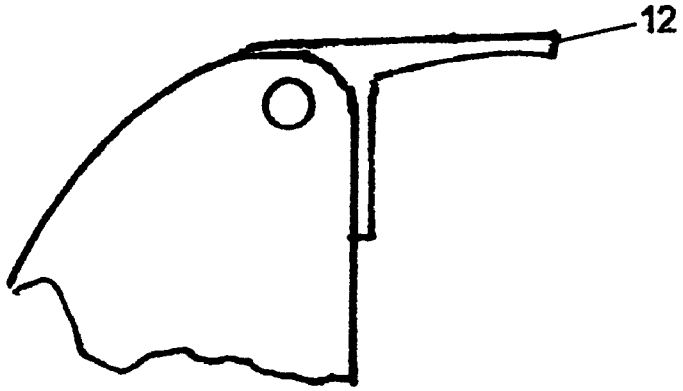
FIG. 13 is a partial cut away side view of the handle of the invention.

FIG. 13 shows the handle 12 of the invention in one position.

Figure 14:
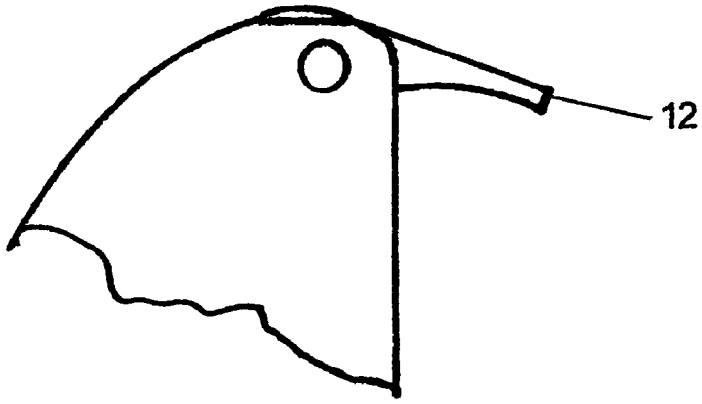
FIG. 14 is another partial cut away side view of the handle of the invention.

FIG. 14 shows the handle 12 of the invention in its pivoted position.

Since many modifications, variations and changes in detail can be made to the described preferred embodiments of the invention, it is intended that all matters in the foregoing description and shown in the accompanying drawings be interpreted as illustrative and not in a limiting sense. Thus the scope of the invention should be determined by the appended claims and their legal equivalents.

What is claimed is:

1. An assist device for a door handle , said assist device comprising:

an elongated bar;

one end of said bar constructed and arranged to pivot about a pivot means;

the other end of said bar constructed and arranged to receive a piece therein;

wherein said piece is attached to said handle, projects outwardly from said handle, in use is immovable relative to said handle, and is not as wide as said handle; the engagement of the piece and the handle creating stop surfaces for the bar as said piece is introduced into the bar;

and wherein said pivot means secures said bar to a u-shaped bracket.

2. The assist device of claim 1, wherein said bar near the pivot area rests entirely within said bracket.

3. The assist device of claim 1, wherein said pivot means consists of a long inside threaded bolt which passes through said bracket and said bar, and a short outside threaded bolt which is screwed into said long bolt.

4. An assist device for a door handle, said assist device comprising;

an elongated bar;

one end of said bar constructed and arranged to pivot about a pivot means;

the other end of said bar constructed and arranged to receive a piece therein;

wherein said piece is attached to said handle, projects outwardly from said handle, in use is immovable relative to said handle, and is not as wide as said handle; the engagement of the piece and the handle creating stop surfaces for the bar as said piece is introduced into the bar;

and wherein said piece is sturdily secured to said handle with two nuts and bolts.

5. The assist device of claim 1, wherein said bracket is sturdily secured to a door or door support with at least two screws.

6. The assist device of claim 1, wherein said pivot means passes through the top part of said bar and through the top part of said u-shaped bracket.

7. An assist device for a door handle, said assist device comprising:

an elongated bar;

one end of said bar constructed and arranged to pivot about a pivot means;

the other end of said bar constructed and arranged to receive a piece;

said piece not as wide as said handle, projecting from said handle, fastened to said handle and in use immovable relative to said handle;

the engagement of the piece and handle creating stop surfaces for the bar as the piece is introduced into the bar; and said pivot means secures a bar end to a u-shaped bracket.

8. The assist device of claim 7, wherein said bar near said pivot means rests entirely within said bracket.

9. The assist device of claim 8, wherein said pivot means passes through the top part of said bar and through the top part of said u-shaped bracket.

10. An assist device for a door handle, said assist device comprising:

an elongated hollow bar;

one end of said bar constructed and arranged to pivot about a pivot pin;

the other end of said bar constructed and arranged to receive a piece therein;

said pivot pin securing said bar to a u-shaped bracket;

said pivot pin comprising a long inside threaded hollow bolt which passes through a top part of said bar and a top part of said bracket, and a short outside threaded bolt screwed into said long bolt;

said piece secured to said handle by two nuts and two bolts, projects from said handle and is not as wide as said handle;

the engagement of the piece and handle creating stop surfaces for the bar as the piece is introduced into the bar;

said piece, bracket and bar being substantially axially aligned along a longitudinal axis.

* * * * *